US006193058B1

(12) United States Patent
Yacko et al.

(10) Patent No.: US 6,193,058 B1
(45) Date of Patent: Feb. 27, 2001

(54) SYSTEM FOR DISPENSING PREMEASURED QUANTITIES OF CONCENTRATED MATERIALS

(75) Inventors: R. Bruce Yacko, Toledo; Jeffrey C. Gayer, Sylvania; Edward L. Mueller, Toledo; John A. Wiegand, Sylvania, all of OH (US)

(73) Assignee: Canberra Corportion, Toledo, OH (US)

( * ) Notice: Subject to any disclaimer, the term of this patent is extended or adjusted under 35 U.S.C. 154(b) by 0 days.

(21) Appl. No.: 09/264,078

(22) Filed: Mar. 5, 1999

(51) Int. Cl.[7] ..... B65D 81/32

(52) U.S. Cl. ..... 206/222; 206/459.5; 206/524.7; 383/37

(58) Field of Search ..... 206/219–222, 206/223, 229, 568, 524.7, 459.5; 383/38–40, 37

(56) References Cited

U.S. PATENT DOCUMENTS

| | | | |
|---|---|---|---|
| 683,994 | 10/1901 | Schirmer . | |
| 2,568,029 | 9/1951 | Seemar . | |
| 2,819,738 | 1/1958 | Marberg . | |
| 2,885,104 | 5/1959 | Greenspan . | |
| 2,965,496 | 12/1960 | Serdar . | |
| 3,415,360 | 12/1968 | Baumann et al. . | |
| 3,533,807 | 10/1970 | Wakefield . | |
| 3,542,566 | 11/1970 | Wakefield . | |
| 3,655,096 | 4/1972 | Easter . | |
| 3,741,383 | 6/1973 | Wittwer . | |
| 3,797,646 | 3/1974 | Horne . | |
| 4,264,007 | 4/1981 | Hunt . | |
| 4,462,224 * | 7/1984 | Dunshee et al. | 206/219 |
| 4,466,547 | 8/1984 | Klittich . | |
| 4,540,089 | 9/1985 | Maloney . | |
| 4,634,003 | 1/1987 | Ueda et al. . | |
| 4,711,359 | 12/1987 | White et al. . | |
| 4,805,799 | 2/1989 | Robbins, III . | |
| 5,287,961 * | 2/1994 | Herran | 206/219 |
| 5,328,055 | 7/1994 | Battle . | |
| 5,370,222 * | 12/1994 | Steigerwald et al. | 206/222 |
| 5,385,251 | 1/1995 | Dunn . | |
| 5,421,483 | 6/1995 | Parise . | |
| 5,549,380 | 8/1996 | Lidgren et al. . | |
| 5,611,776 | 3/1997 | Simmons et al. . | |
| 5,741,534 * | 4/1998 | Chung | 206/219 |

* cited by examiner

*Primary Examiner*—Jim Foster
(74) *Attorney, Agent, or Firm*—MacMillan, Sobanski & Todd, LLC

(57) ABSTRACT

A liquid dispensing bag has a sealed concentrate pouch and a mixing pouch, the concentrate pouch having a fluid tight seal separating the concentrate pouch from the mixing pouch, and the concentrate pouch containing a base material at a first concentration. Upon the introduction of diluent into the mixing pouch, and upon the rupturing of the fluid tight seal, the concentrate pouch and the mixing pouch will be in communication with each other, and the diluent and the base material can mix to form a solution in which the concentration of the base material will be at a second, lesser concentration than the first concentration.

24 Claims, 4 Drawing Sheets

SYSTEM FOR DISPENSING PREMEASURED QUANTITIES OF CONCENTRATED MATERIALS

TECHNICAL FIELD

This invention relates to a system for efficiently dispensing materials such as liquids. More particularly, this invention pertains to a system for efficiently preparing and dispensing liquids, such as solvents, of the type that are advantageously or preferably not allowed to come in contact with human skin.

BACKGROUND OF THE INVENTION

Industrial and commercial firms frequently require the use of industrial solutions, including cleaning solutions, disinfectant solutions and solvents, for various purposes. In hospitals, for example, disinfectant solutions are often used on floors and other surfaces to assure a clean environment. Traditional technology for disbursing and handling these industrial solutions typically involves shipping the solution in bulk to the facility requiring the solution, and measuring out quantities of the solution for each use required. This system is disadvantageous in that it requires the shipping of a large amount of bulky, heavy fluid.

Advances in the field of disbursing solutions have lead to the use of concentrates dispensed from a central location for dilution and use in various locations within an industrial or commercial facility. The concentrates can be either in a liquid or a solid form. While the use of concentrates is an improvement over shipping fully diluted solutions, for large industrial and commercial facilities this system requires either multiple dispensing locations or repeated trips over large distances to return to the dispensing location for refilling individual dispensing containers.

The use of mixing bags having a sealed pouch or pocket with a concentrate is known, as disclosed in U.S. Pat. Nos. 3,533,807 and 3,542,566, both to Wakefield. Other patents disclose systems in which two substances are kept separate until mixing is desired, as disclosed, for example, in U.S. Pat. No. 3,741,383 to Wittwer, U.S. Pat. No. 3,797,646 to Horn, and U.S. Pat. No. 4,264,007 to Hunt.

It is known to break the seal between the two compartments of a dispensing bag by pulling apart the two sides of the bag. U.S. Pat. No. 4,711,359 to White et al., discloses a selectively openable seal line 54 that can be opened or broken by grasping the opposite sheets or sides of the bag. The sides of the bag must be pulled to break the seal prior to insertion of the bag into the bottle or container.

U.S. Pat. No. 4,540,089 to Maloney discloses a process for forming in-line bags suitable for filling with different mixtures. The bags are formed from rolls of film, and the bags, still attached to each other, are wound up in a tear off roll before being shipped to a bag filing facility. At the bag filling facility the bags are filled and detached from the roll and packaged for sale.

It would be advantageous if a system could be developed for more simply handling, disbursing and diluting concentrated materials. Such a system would preferably allow the user of the concentrated materials to avoid touching or contact with the concentrate. Further, such a system would also eliminate the need for those using or dispensing the solution to return to a central dispensing station for refilling individual dispensing containers. Further, such a system would enable the efficient dispensing of premeasured quantities of concentrated materials.

SUMMARY OF THE INVENTION

The above objects as well as other objects not specifically enumerated are achieved by a tearoff roll containing a plurality of connected but separable liquid dispensing bags, each dispensing bag having a sealed concentrate pouch and a mixing pouch, the concentrate pouch having a fluid tight seal separating the concentrate pouch from the mixing pouch, and the concentrate pouch containing a base material at a first concentration, wherein upon the introduction of diluent into the mixing pouch, and upon the rupturing of the fluid tight seal, the concentrate pouch and the mixing pouch will be in communication with each other, and the diluent and the base material can mix to form a solution in which the concentration of the base material will be at a second, lesser concentration than the first concentration.

In another embodiment of the invention, there is provided a system of dispensing premeasured concentrations of a solution at multiple locations in a facility. The system includes the step of providing dispensing bags at multiple locations in the facility, where the dispensing bags have a sealed concentrate pouch and a mixing pouch. The concentrate pouch has a fluid tight seal separating the concentrate pouch from the mixing pouch, and the concentrate pouch contains a base material at a first concentration. Upon the introduction of diluent into the mixing pouch, and upon the rupturing of the fluid tight seal, the concentrate pouch and the mixing pouch will be in communication with each other, and the diluent and the base material can mix to form a solution in which the concentration of the base material will be at a second, lesser concentration than the first concentration. A diluent is introduced into the mixing pouches and the fluid tight seals of the dispensing bags are ruptured to obtain premeasured concentrations of the solution, and the solution is dispensed.

According to this invention, there is also provided a liquid dispensing bag containing a base material at a first concentration, wherein upon the introduction of diluent into the dispensing bag, the diluent and the base material can mix to form a solution in which the concentration of the base material will be at a second, lesser concentration than the first concentration. The dispensing bag contains opposed flaps which when pulled in opposite directions can be spread around a container to attach the dispensing bag to the container. The flaps have a first label visible before the flaps are pulled in opposite directions, and have a second label visible after the flaps are pulled in opposite directions and spread around the container.

In another embodiment, the invention comprises a liquid dispensing bag having a sealed concentrate pouch and a mixing pouch, the concentrate pouch having a fluid tight seal separating the concentrate pouch from the mixing pouch, and the concentrate pouch containing a base material at a first concentration. Upon the introduction of diluent into the mixing pouch, and upon the rupturing of the fluid tight seal, the concentrate pouch and the mixing pouch will be in communication with each other, and the diluent and the base material can mix to form a solution in which the concentration of the base material will be at a second, lesser concentration than the first concentration.

DETAILED DESCRIPTION AND PREFERRED EMBODIMENTS OF THE INVENTION

Figure 1:
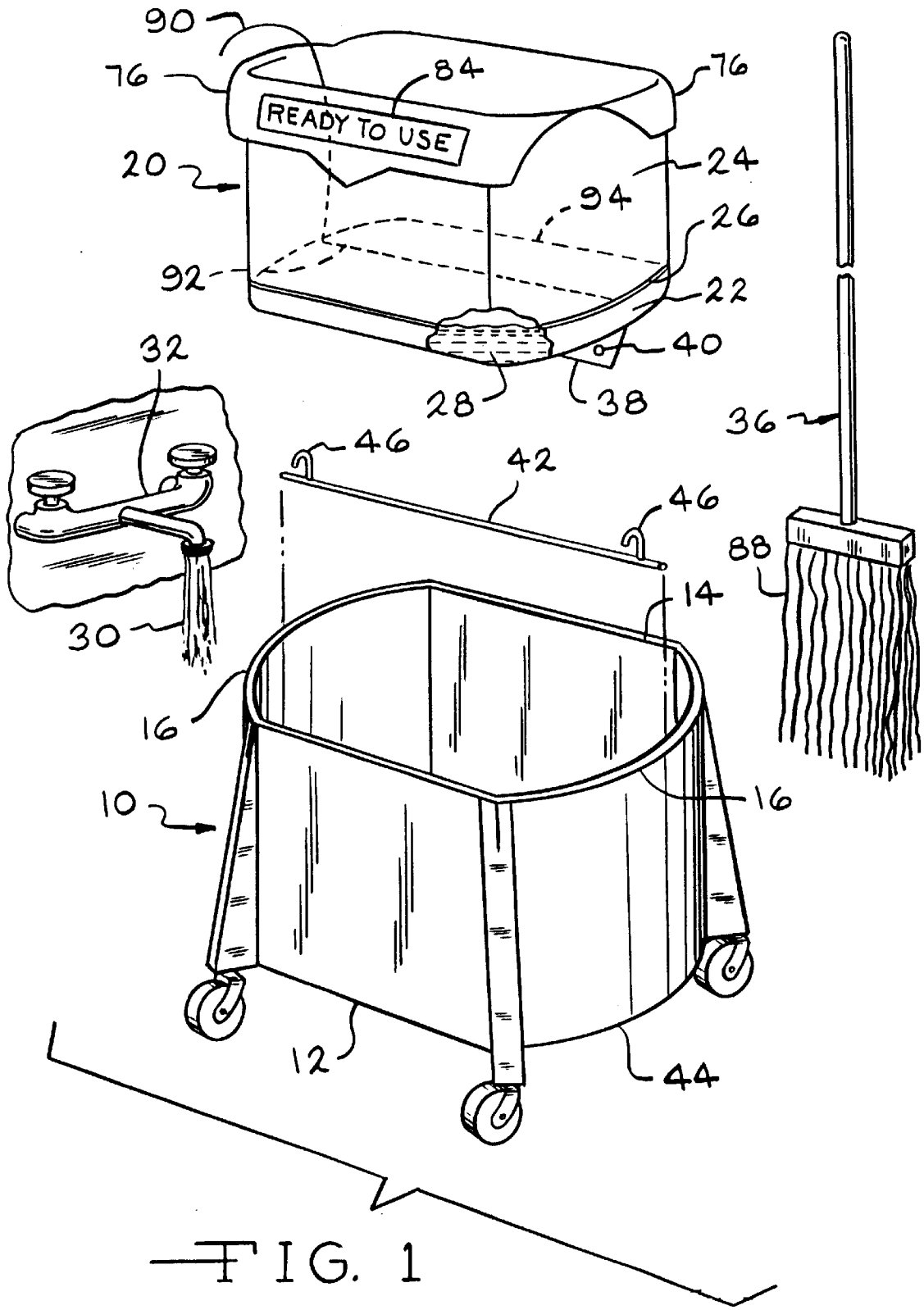
FIG. 1 is an exploded schematic view of a mop bucket and appropriately shaped dispensing bag according to this invention.

In a specific embodiment, the invention pertains to a system using plastic bags containing premeasured amounts of concentrated materials that can be inserted into a dispenser and diluted to form a solution having the desired concentration. As shown in FIG. 1, the system for dispensing premeasured concentrations of a solution according to the invention is illustrated. The system includes a container, such a mop bucket 10 that has generally vertical front and rear walls 12, 14 and generally curved sidewalls 16. The mop bucket can be of any size or shape suitable for holding quantities of the liquid materials that need to be dispensed. Many types of containers other than mop buckets can be used with the invention. The mop bucket 10 can be made of any suitable material, such as a strong plastic material or a galvanized metal.

A dispensing bag 20 includes a sealed concentrate pouch 22 and a mixing pouch 24. The sealed concentrate pouch 22 is separated from the mixing pouch by a fluid tight seal 26. The fluid tight seal 26 does not need to be straight across, transverse to the axis of the container or mop bucket 10 as shown, but can be in any orientation. A dispensing bag suitable for use with a mop bucket could have a capacity of 5 gallons, for example, although other sizes could be used as well. Contained within the concentrate pouch 22 is a liquid base material 28 in concentrated form. It is to be understood that alternatively the base material 28 can be in a solid form. The base material 28 contained in the sealed concentrate pouch is present in a concentrated form, or at a first concentration, when compared to the concentration of the base material after mixing with a diluent 30. The diluent 30 can be any liquid suitable for diluting the base material to a lower concentration. The typical diluent is water, although other diluents can be used. The base material can be any material that can be diluted to a lesser concentration. Typical base materials suitable for use in with a mop bucket include concentrated cleaning materials, solvents and disinfectants, or combinations of these. As an example, a liquid ABC disinfectant having a concentration of X could be used as the base material, and after dilution with water, the resulting solution could have a concentration of Y. As will be explained below other base materials that would be more suitable for the bottles illustrated in FIGS. 3–7 would include insecticides, herbicides, medicines and food products.

For various reasons it is desirable for the user to be able to prepare and dispense the mixed, diluted solution without physically contacting the base material, or the liquid solution. In order to accomplish this, the user inserts the dispensing bag 20 into the mop bucket 10, with the concentrate pouch 22 of the dispensing bag containing the base material. The user then breaks the fluid tight seal 26, exposing the base material to the mixing pouch 24. The user then adds a diluent, such as water 30, from any suitable source, such a tap 32, to the dispensing bag to make a solution having a predetermined or premeasured concentration. The solution, having the desired, premeasured concentration, can then be dispensed by the user, such as by using a mop 36. A particular advantage of the invention is that the user can reload the dispensing bottle with a new bag at remote locations (as long as there is water available) and need not return to a fixed dispensing station for a refill, and also need not touch the concentrated liquid since the dispensing bag can be disposed of. It is to be understood that the seal can be broken either before or after the water is added.

The dispensing bag 20 is shown as having a tab 38, with a tab orifice 40 for use in attaching the bag to the bottom of the mop bucket 10. Preferably the mop bucket is provided with a hook, not shown, suitable for attaching the tab 38 to the hook, and consequently for attaching the dispensing bag to the bucket. Two or more hooks and two or more orifices and tabs could be used. In the absence of a hook mounted directly on the mop bucket, a hook insert 42 can be inserted into the interior of the mop bucket. The hook insert 42 can be any structure relatively easily insertable into the bucket and having a hook suitable for attaching the tab of the dispensing bag. As shown, the hook insert 42 is comprised of a stiff wire or rod having a length longer than the inside dimension of the bucket 10 so that the wire can be jammed or wedged into the bottom end 44 of the bucket. The hook insert 42 is provided with two hooks 46 suitable for engaging a pair of tabs 40. Other means of attaching one or more hooks can be used.

Figure 2:
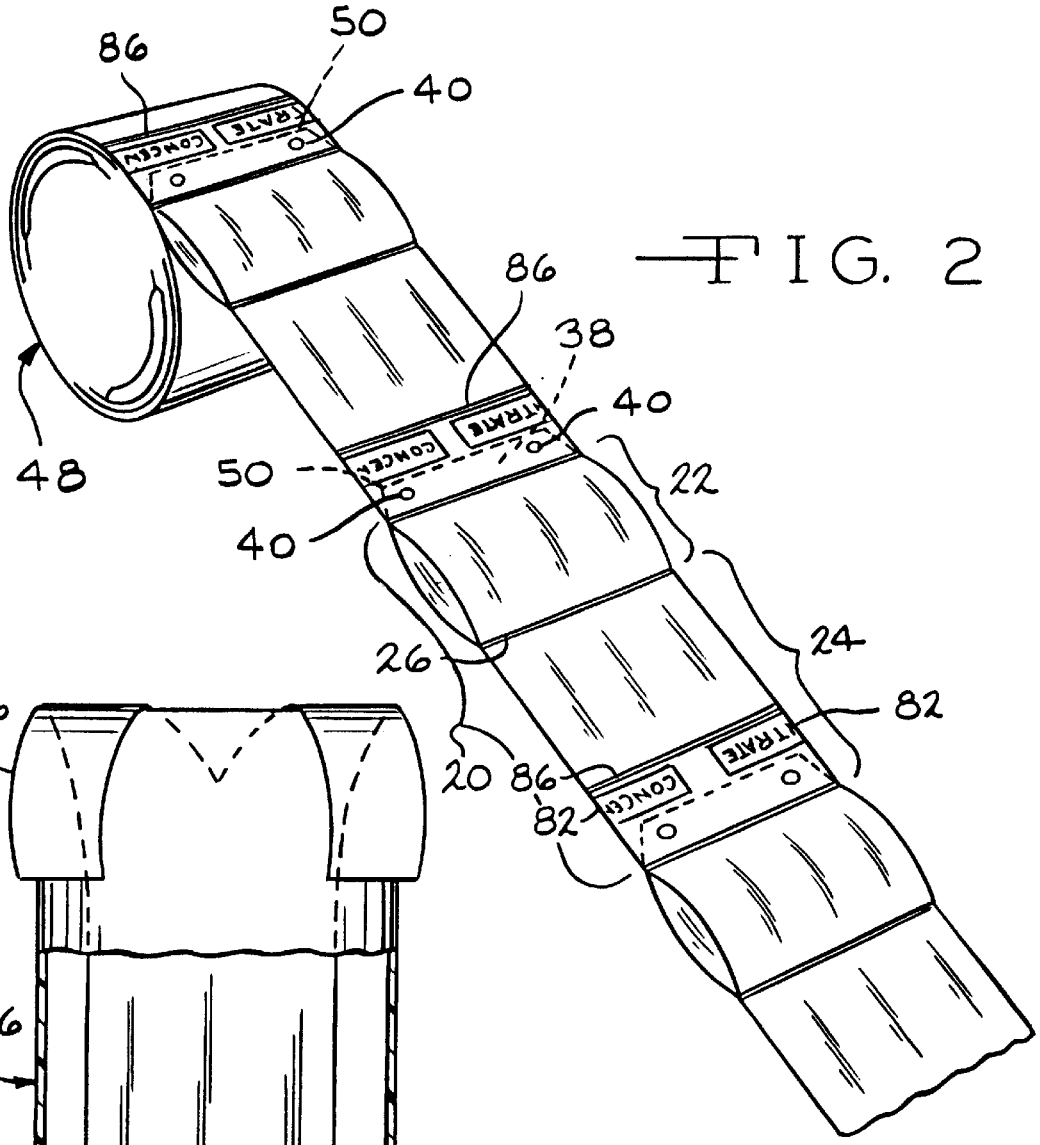
FIG. 2 is a schematic view in perspective of a tearoff roll of dispensing bags of the invention.

As shown in FIG. 2, the dispensing bags can be provided to the user of the dispensing system of the invention in the form of a continuous roll 48 of dispensing bags 20 that can be torn off as needed for easy dispensing at the user's location. The dispensing bags are sealed with the fluid tight seals 26, keeping the concentrate or base material 28 away from human contact until the fluid tight seal is broken. The dispensing bags are joined into the continuous roll by tear off perforations 50. The concentrate pouches 22 of each bag are filled with the base material and sealed. The tearoff roll 48 of dispensing bags can be stationed at a central location at the customer's industrial or commercial facility, and the dispensing bags can be torn off as needed. In the alternative, a quantity of the bags can be taken to various sites throughout the facility, or can be carried on mobile equipment, such as maintenance carts. Although the concentrate pouch 22 is shown at the bottom of the dispensing bag, it could be positioned at the top of the dispensing bag as well. The bag could be provided with a pleat, not shown, to make it more easily adaptable to a container having a cylindrical or other shape. The dispensing bags themselves can be made using form-fill-and-seal technology, which is well known in the art.

Figure 4:
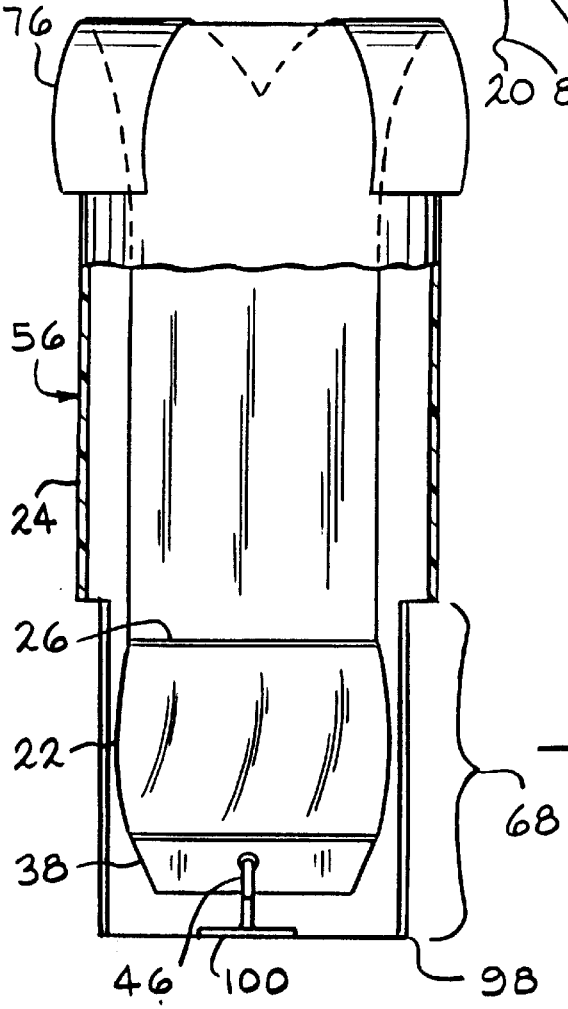
FIG. 4 is a schematic view in elevation of the dispensing bag and bottle.
Figure 3:
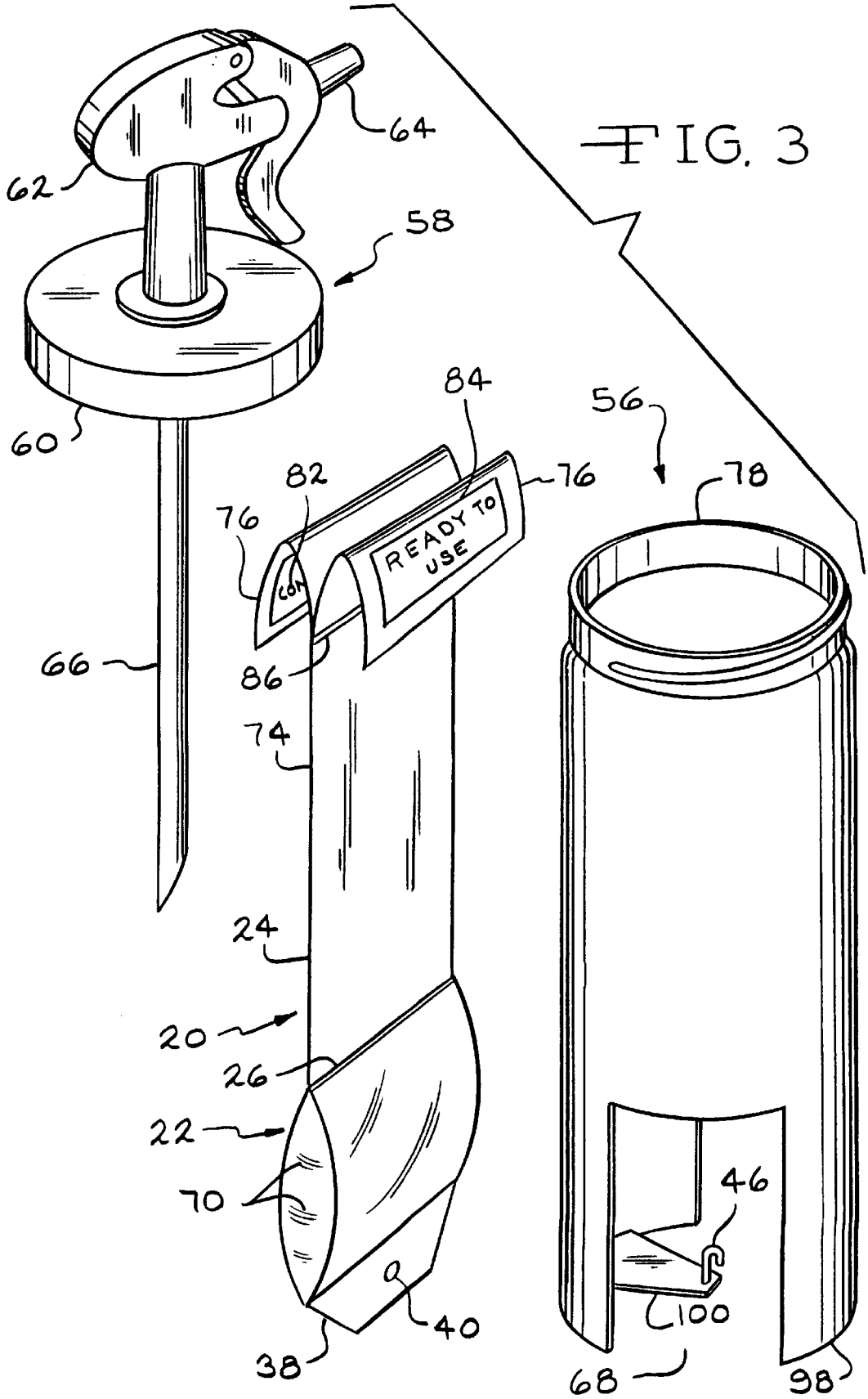
FIG. 3 is a schematic exploded view in perspective of an individual dispensing bottle and a dispensing bag according to the present invention.

As shown in FIGS. 3 and 4, the dispensing bags 20 of the invention can be used with a bottle 56 and a dispensing closure 58. The dispensing closure 58 can be any closure suitable for dispensing the solution, but preferably includes a cap 60, pump 62 and nozzle 64, as shown. The pump stem or updraw tube 66 can be sharpened or angled to facilitate the breaking of the fluid tight seal 26 upon the insertion of the dispensing closure 58 onto the bottle. The bottle 56 includes two optional access openings 68 for grasping the dispensing bag to break the fluid tight seal 26 and allow the concentrated base material 28 to be free to mix with the diluent added to the dispensing bag, as shown in FIGS. 3 and 4. To that end the dispensing bag can be provided with opposed ears 70 suitable for helping the user grasp the plastic material to pull apart the fluid tight seal The upper portion 74 of the bag has flaps 76 that can be pulled down over the rim 78 of the bottle 56 to secure the dispensing bag 20 to the bottle. The flaps 76 are preferably adapted to provide a labeling system to indicate whether the material in the dispensing bag is in a concentrated form or in a diluted form. To accomplish this, the flaps 76 are provided with a first label 82 indicative of the fact that the base material contained within the concentrate pouch 22 is in a concentrated form. As shown in FIG. 2, this first label 82 is visible when the dispensing bags 20 are being payed out from the tearoff roll 48, and the first label also would be visible when an individual dispensing bag is removed from the tearoff roll. However, when the flaps 76 are pulled in opposite directions and spread around a container to attach the dispensing bags to the container, a second label, such as ready to use label 84 is visible, as shown in FIGS. 1 and 3. This second label is indicative of the fact that the material in the dispensing bag 20 is diluted with the diluent, or is in a condition ready to accept the diluent. It is to be understood that any label or message or label can be used in this manner, such as for example mixing instructions for the user of the dispensing bag.

Although the dispensing bag can comprise a sealed concentrate pouch 22 and a non-sealed or open mixing pouch 24, in a preferred embodiment of the invention the dispensing bag is provided with a mixing pouch seal 86 to close off the mixing pouch from external access. The mixing pouch seal 86 can act as an additional barrier to prevent leakage of the concentrated base material 28 in case of failure of the fluid tight seal 26. The mixing pouch seal can be of any type, such as a weld in the plastic material of the dispensing bag, and is preferably a seal that is easily openable, such as a Ziploc® fastener seal. Most preferably, the mixing pouch seal can be opened by pulling apart the opposed flaps 76.

A key aspect of the invention is providing a safe, easy and foolproof mechanism for rupturing of the fluid tight seal 26 so that the added water can mix with the concentrated base material 28 to form the solution having the desired concentration. The fluid tight seal can be made weaker than the other welds in the dispensing bag, and in particular can be made weaker than the mixing pouch seal 86. With a relatively weak fluid tight seal, the user of the dispensing bag and system of the invention can break the fluid tight seal by pressing down with the wet or absorbent end 88 of the mop 36, shown in FIG. 1. Alternatively, a string or ripcord 90 can be attached to a break line 92 in the fluid tight seal. The break line 92, shown in FIG. 1 as extending across the fluid tight seal 26, can be relatively easily separated or ruptured by pulling on the rip cord. Optionally, the fluid tight seal can be provided with a perimeter breakline 94, which when ruptured will enable detachment of nearly the entire fluid tight seal 26 from the dispensing bag. In this embodiment, the dispensing bag 20 is defined by bag walls 96, and the fluid tight seal 26 comprises a panel attached to the bag walls 96 of the dispensing bag along the perimeter a line of attachment, i.e., the perimeter breakline 94, wherein the ripcord is oriented along the line of attachment.

In an alternate embodiment of the invention, the fluid tight seal can be made of a water soluble material that will dissolve or otherwise become porous upon the introduction of water or other diluent into the mixing pouch. Additionally, the fluid tight seal can be heat sensitive so that the introduction of very hot water into the mixing pouch causes the fluid fight barrier to disintegrate or otherwise become porous, allowing mixing of the base material and the diluent to form a solution of the desired concentration. "Very hot water" is defined as being over 110° F.

Figure 5:
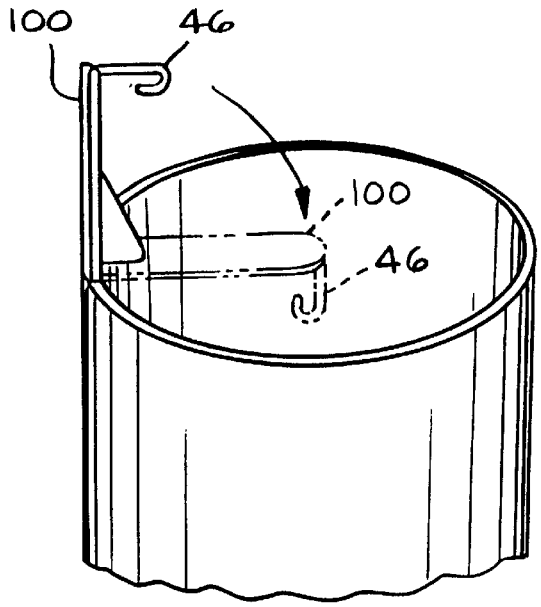
FIG. 5 is a perspective view schematically illustrating an upside down view of a bottle showing a hinged retainer flange and hook for securing the bottom of the bag to the bottle.
Figure 6:
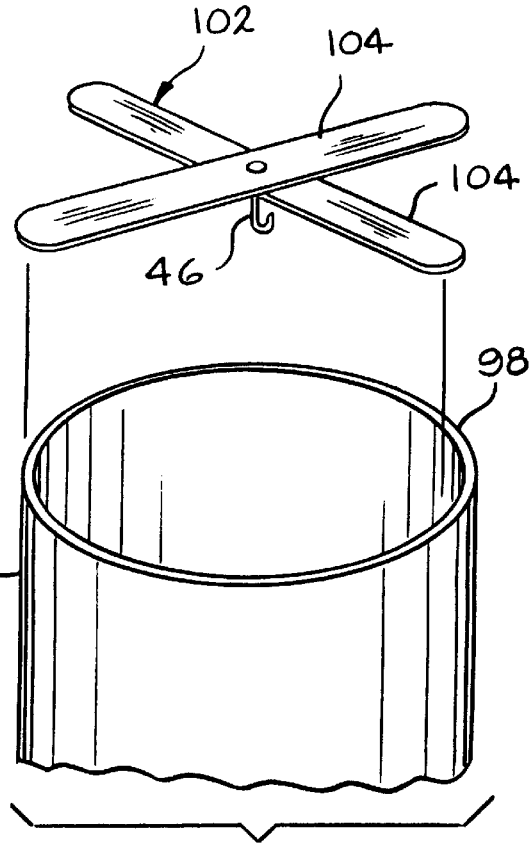
FIG. 6 is similar to FIG. 5, illustrating an add on cross piece for securing the bottom of the bag to the bottle.
Figure 7:
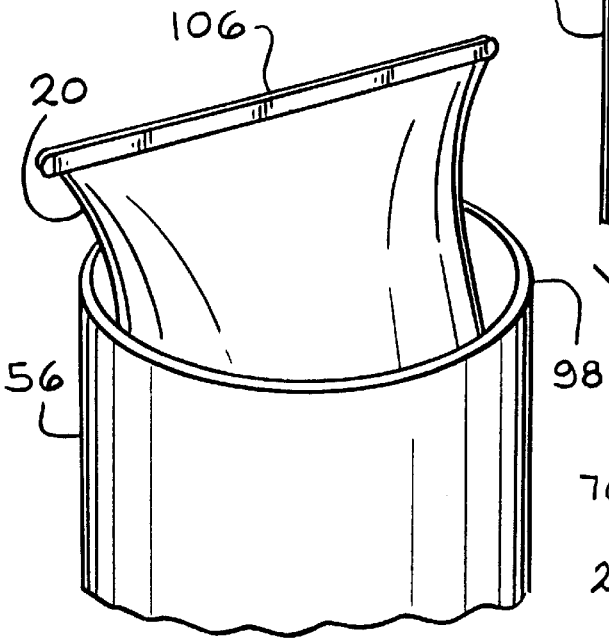
FIG. 7 is similar to FIG. 5, illustrating the use of a stiff plastic bar that spans the bottom rim of the bottle to secure the bottom of the bag to the bottle.

Various methods for attaching the bottom of the dispensing bag to the bottom of the container can be used. As shown in FIGS. 3 and 4–7, the bottom 98 of the bottle 56 can be provided with a hook 46 to which the tab 38 can be attached to secure the bottom of the dispensing bag to the bottom of the bottle 56. The bottom 98 of the bottle is provided with a retainer 100 for securing the bottom of the bag to the bottle. The retainer can be of any design suitable to attach the dispensing bag 20 to the bottle. As shown in FIGS. 3 and 5, the retainer 100 can be a flange molded during the molding of the bottle, such as by injection molding, and could be bendable about a hinge to be in the position shown in phantom in FIG. 5. As illustrated in FIG. 6, the retainer 100 could be in the form of a crosspiece 102 having two legs 104 that are sufficiently long that they span the bottom 98 of the bottle. As a variation of the crosspiece 102 shown, the retainer could consist of a single leg 104. As an additional variation shown in FIG. 7, the dispensing bag 20 itself could also be provided with a stiff plastic bar 106 that is wider than the bottom rim 98 of the bottle 56 so that the dispensing bag will be held in place when placed under tension by the pulling down of the flaps 76 around the upper rim 78 of the bottle. It is to be understood that the fluid tight seal 26 could be welded into the interior of the dispensing bag in such a way that when the bag is placed under tension by attaching the tab orifice 40 on the hook 46, and by pulling down on the flaps 76 over the rim 78 of the bottle, the fluid tight seal is broken. Other methods for breaking the fluid tight seal 26 include a pin or other cutting implement mounted on the bottle 56 itself, wherein the placing of the dispensing bag within the bottle would cause the fluid tight seal to rupture.

Figure 8:
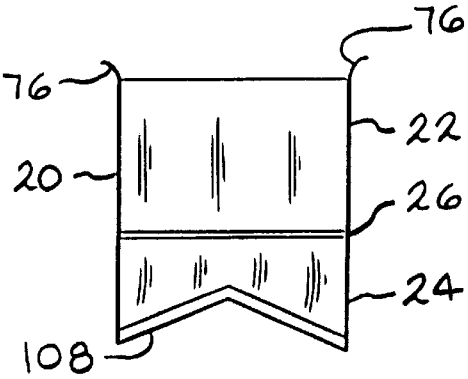
FIG. 8 is an elevational end view of a dispensing bag of the invention in which the bottom of the bag is gusseted to make the dispensing bag into a stand alone bag.

In FIG. 8 there is illustrated a dispensing bag 20 of the invention in which the bottom 108 of the dispensing bag is gusseted or otherwise formed with pleats or folds so that the bag can stand upright without being supported by a container such as a bottle or mop bucket.

One of the great advantages of the system of dispensing premeasured concentrations of a solution according to the present invention is that the bottle or other container and new bags could be easily transported and stored at various locations, and all that is needed to refill the dispensing container is a new bag and a source of tap water.

The principle and mode of operation of this invention have been described in its preferred embodiments. However, it should be noted that this invention may be practiced otherwise than as specifically illustrated and described without departing from its scope.

What is claimed is:

1. A tearoff roll containing a plurality of connected but separable liquid dispensing bags, each dispensing bag having a sealed concentrate pouch and a mixing pouch, the concentrate pouch having a fluid tight seal separating the concentrate pouch from the mixing pouch, and the concentrate pouch containing a base material at a first concentration, wherein upon the introduction of diluent into the mixing pouch, and upon the rupturing of the fluid tight seal, the concentrate pouch and the mixing pouch will be in communication with each other, and the diluent and the base material can mix to form a solution in which the concentration of the base material will be at a second, lesser concentration than the first concentration.

2. The tearoff roll of claim 1 in which the mixing pouch includes a mixing pouch seal capable of being opened for external access to the mixing pouch.

3. The tearoff roll of claim 2 in which the dispensing bag contains opposed flaps which when pulled in opposite directions break the mixing pouch seal to open the mixing pouch.

4. The tearoff roll of claim 1 in which the dispensing bag contains opposed flaps which when pulled in opposite directions can be spread around a container to attach the dispensing bag to the container.

5. The tearoff roll of claim 1 in which the dispensing bag contains at least one tab configured to be connected to a bottom end of a container to attach the dispensing bag to the container.

6. The tearoff roll of claim 1 in which the base material is a liquid.

7. The tearoff roll of claim 1 in which the fluid tight seal includes a rip cord configured to rupture the fluid tight seal when pulled.

8. The tearoff roll of claim 7 in which the dispensing bag is defined by bag walls, and in which the fluid tight seal comprises a panel attached to the walls of the dispensing bag along a line of attachment, wherein the ripcord is oriented along the line of attachment.

9. The tearoff roll of claim 1 in which the mixing pouch includes a mixing pouch seal capable of being opened for external access to the mixing pouch, and in which the fluid tight seal is weaker than the mixing pouch seal.

10. The tearoff roll of claim 9 in which the fluid tight seal is capable of being ruptured by the application of pressure from the end of a mop that contains absorbent material.

11. The tearoff roll of claim 1 in which the concentrate pouches contain opposed ears which when pulled in opposite directions break the fluid tight seal.

12. The tearoff roll of claim 1 in which the dispensing bags contain opposed flaps which when pulled in opposite directions can be spread around a container to attach the dispensing bags to the container, and wherein the flaps have a first label visible before the flaps are pulled in opposite directions, and have a second label visible after the flaps are pulled in opposite directions and spread around the container.

13. The tearoff roll of claim 12 in which the dispensing bag has a bottom structured to enable the dispensing bag to stand upright without being supported by a container.

14. The tearoff roll of claim 1 in which the fluid tight seal is made of a water soluble material that becomes porous upon the introduction of a diluent into the mixing pouch.

15. The tearoff roll of claim 1 in which the fluid tight seal becomes porous upon the introduction of very hot water into the mixing pouch.

16. A liquid dispensing bag containing a base material at a first concentration, wherein upon the introduction of diluent into the dispensing bag, the diluent and the base material can mix to form a solution in which the concentration of the base material will be at a second, lesser concentration than the first concentration, wherein the dispensing bag contains opposed flaps which when pulled in opposite directions can be spread around a container to attach the dispensing bag to the container, and wherein the flaps have a first label visible before the flaps are pulled in opposite directions, and have a second label visible after the flaps are pulled in opposite directions and spread around the container.

17. The liquid dispensing bag of claim 16 in which the dispensing bag is assembled with other dispensing bags in the form of a tearoff roll containing a plurality of connected but separable liquid dispensing bags.

18. The liquid dispensing bag of claim 16 having a sealed concentrate pouch and a mixing pouch, the concentrate pouch having a fluid tight seal separating the concentrate pouch from the mixing pouch, and the concentrate pouch containing the base material at the first concentration, wherein upon the introduction of the diluent into the mixing pouch, and upon the rupturing of the fluid tight seal, the concentrate pouch and the mixing pouch will be in communication with each other, and the diluent and the base material can mix to form the solution.

19. The liquid dispensing bag of claim 18 wherein when the opposed flaps are pulled in opposite directions, the mixing pouch seal is broken to open the mixing pouch.

20. The liquid dispensing bag of claim 16 which the base material is a liquid.

21. The liquid dispensing bag of claim 16 in which the fluid tight seal includes a rip cord configured to rupture the fluid tight seal when pulled.

22. The liquid dispensing bag of claim 16 having a sealed concentrate pouch and a mixing pouch, the concentrate pouch having a fluid tight seal separating the concentrate pouch from the mixing pouch, and the mixing pouch including a mixing pouch seal capable of being opened for external access to the mixing pouch, and in which the fluid tight seal is weaker than the mixing pouch seal.

23. The liquid dispensing bag of claim 22 in which the fluid tight seal is capable of being ruptured by the application of pressure from the end of a mop that contains absorbent material.

24. The liquid dispensing bag of claim 16 having a bottom structured to enable the dispensing bag to stand upright without being supported by a container.

* * * * *